US011825963B2

(12) United States Patent
Coan et al.

(10) Patent No.: US 11,825,963 B2
(45) Date of Patent: Nov. 28, 2023

(54) RETAIL PRODUCT PACKAGE AND DISPLAY

(71) Applicant: LIBERTY HARDWARE MFG. CORP., Winston-Salem, NC (US)

(72) Inventors: Yasmeen Gabrielle Coan, Winston-Salem, NC (US); William Matthew Hicks, Winston-Salem, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 128 days.

(21) Appl. No.: 17/175,627

(22) Filed: Feb. 13, 2021

(65) Prior Publication Data

US 2021/0251400 A1 Aug. 19, 2021

Related U.S. Application Data

(60) Provisional application No. 62/976,012, filed on Feb. 13, 2020.

(51) Int. Cl.
*A47F 5/11* (2006.01)
*A47F 5/00* (2006.01)
(Continued)

(52) U.S. Cl.
CPC ..... *A47F 5/112* (2013.01); *A47F 5/0006* (2013.01); *B65D 5/48024* (2013.01);
(Continued)

(58) Field of Classification Search
CPC ..... A47F 5/0006; A47F 5/101; A47F 5/108; A47F 5/112; A47F 5/0018; A47F 5/10; A47F 5/11; A47F 5/116; A47F 5/0815; A47F 5/08; B65D 25/005; B65D 25/04; B65D 25/08; B65D 25/10; B65D 5/48024; B65D 5/5213; B65D 1/22; B65D 19/00;
(Continued)

(56) References Cited

U.S. PATENT DOCUMENTS 4,671,417 A * 6/1987 O'Brien ..... A47F 5/0807 248/224.8
4,809,856 A 3/1989 Muth
(Continued)

FOREIGN PATENT DOCUMENTS

EP 2957195 A1 12/2015
WO WO-03047396 A1 * 6/2003 ..... A47F 5/0815

OTHER PUBLICATIONS

Begonia, S., Amazon.com, ASIN: B00OILM3KW, Date First Available: Oct. 15, 2014 (Year: 2014).*
(Continued)

*Primary Examiner* — Anthony D Stashick
*Assistant Examiner* — Marcos Javier Rodriguez Molina
(74) *Attorney, Agent, or Firm* — Brooks Kushman P.C.; Lora Graentzdoerffer

(57) ABSTRACT

A packaging assembly is provided with a product package. A plurality of retail products is supported upon the product package in an array for transportation. A plurality of dividers is connected to the product package and extends between sequential retail products for separation of the sequential retail products during shipping, wherein the dividers are removable.

20 Claims, 6 Drawing Sheets

(51) Int. Cl.

| | |
|---|---|
| ***B65D 5/49*** | (2006.01) |
| ***B65D 5/52*** | (2006.01) |
| ***B65D 25/00*** | (2006.01) |
| ***B65D 25/04*** | (2006.01) |
| ***B65D 25/08*** | (2006.01) |
| ***B65D 25/10*** | (2006.01) |
| *A47F 5/08* | (2006.01) |
| *A47F 5/10* | (2006.01) |

(52) U.S. Cl.
CPC ..... *B65D 5/5213* (2013.01); *B65D 25/005* (2013.01); *B65D 25/04* (2013.01); *B65D 25/08* (2013.01); *B65D 25/10* (2013.01); *B65D 5/52* (2013.01)

(58) Field of Classification Search
CPC ..... B65D 25/106; B65D 5/00; B65D 5/50; B65D 5/52; B65D 81/00; B65D 81/02; B65D 73/0064; A47B 43/00; A47B 43/02; A47B 47/00; A47B 55/06
USPC ..... 206/40, 460, 736, 740, 744, 750, 756, 206/764, 766, 767; 220/532, 533
See application file for complete search history.

(56) References Cited

U.S. PATENT DOCUMENTS 5,148,942 A * 9/1992 Snook ..... B65D 25/06 206/561
9,949,579 B1 * 4/2018 Frost ..... A47F 5/116

OTHER PUBLICATIONS

Command Key Rail, Slate, 1-Rail, 6-Strips, Organize Damage-Free, AMAZON.com, ASIN B00OILM3KW (Year: 2014) (Year: 2014).*
Command Key Rail, Slate, 1-Rail, 6-Strips, Organize Damage-Free, amazon.com, ASIN: B00OILM3KW (Year: 2014).*

* cited by examiner

RETAIL PRODUCT PACKAGE AND DISPLAY

CROSS-REFERENCE TO RELATED APPLICATIONS

This application claims the benefit of U.S. provisional application Ser. No. 62/976,012 filed Feb. 13, 2020, the disclosure of which is hereby incorporated in its entirety by reference herein.

TECHNICAL FIELD

Various embodiments relate to packaging assemblies for retail products.

BACKGROUND

The prior art has provided packaging assemblies for retail products and display assemblies for displaying products.

SUMMARY

According to an embodiment, a packaging assembly is provided with a product package. A plurality of retail products is supported upon the product package in an array for transportation. A plurality of dividers is connected to the product package and extends between sequential retail products for separation of the sequential retail products during shipping, wherein the dividers are removable.

According to a further embodiment, the product package is further provided with a back panel. A base panel is connected to a lower edge of the back panel. A top panel is connected to an upper edge of the back panel. A pair of side panels is each connected to a lateral side of the back panel. The back panel, the base panel, the top panel, and the pair of side panels define an opening for access to the plurality of retail products supported upon, and displayed within, the product package.

According to an even further embodiment, the product package is sized to hang or stand freely as a display assembly.

According to another even further embodiment, an arrayed hole pattern is formed in the back panel. The packaging assembly is further provided with a plurality of pegs mounted to the arrayed hole pattern. The plurality of retail products is supported upon the plurality of pegs.

According to another even further embodiment, at least one of the plurality of retail products is further provided with a card backer with an aperture sized to receive one of the pegs.

According to an even further embodiment, at least one of the plurality of retail products is further provided with a home hardware product.

According to an even further embodiment, the home hardware product is further provided with a hook.

According to another further embodiment, at least one of the plurality of retail products is displayed open to permit tactile interaction by customers.

According to another further embodiment, an outer case sized to be installed at least partially over the product package to cover the opening to enclose the plurality of retail products in the product package for shipping of the packaging assembly.

According to another further embodiment, a plurality of apertures is formed in at least one of the pair of side panels.

The plurality of dividers extends through the plurality of apertures to align the plurality of dividers and to support the plurality of dividers.

According to a further embodiment, the plurality of dividers extends through the apertures in the at least one of the pair of side panels for access to the plurality of dividers for removal of the plurality of dividers from the packaging assembly.

According to another further embodiment, each of the plurality of dividers is formed with a score line along the divider to fold a distal end of the divider against an adjacent side panel of the pair of side panels.

According to another further embodiment, the product package is further provided with a front footer connected to the base panel and the pair of side panels. A front header panel is connected to the top panel and the pair of side panels.

According to another further embodiment, the product package is formed integrally from a common sheet of material.

According to an even further embodiment, the product package is formed from corrugated cardboard.

According to another embodiment, a method for packaging products packs retail products in an array within a product package. Removable dividers are installed between sequential retail products. The product package is shipped with retail products to a retailer.

According to a further embodiment, the product package is formed with a pair of side panels. The removable dividers are installed through apertures in the pair of side panels.

According to another further embodiment, the product package is formed with an opening to display the retail products. An outer cover is installed over the product package to enclose the opening and retain the retail products prior to shipping the product package.

According to another embodiment, a method for retailing products receives a package of packed retail components at a retail location. Removable dividers are removed from between the packed retail components. The package of packed retail components is placed for retail at the retail location.

According to a further embodiment, an outer case is removed from the package to reveal an opening for access to packed retail components before removing the dividers.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

FIGS. 1-5 illustrate a display assembly 20 for displaying retail products at a point-of-sale or retail location. The display assembly 20 may be manufactured for limited use and designed to be recycled after use. The display assembly 20 may be manufactured from cardboard or any suitable material that is lightweight, low cost and has significant structural integrity to be hung from a retail display frame or to stand freely. In the depicted embodiment, the display assembly 20 may be a merchandiser sized for display at the end of a store or retail aisle, often referred to as a sidekick. The display assembly 20 is designed to hang from a cage-like wire frame that is mounted to shelving at an end of an aisle, often referred to as an endcap. Alternatively, the display assembly 20 may be supported upright upon an underlying support surface, such as a floor. The display assembly 20 is also designed for packaging and shipping of the retail products.

Figure 1:
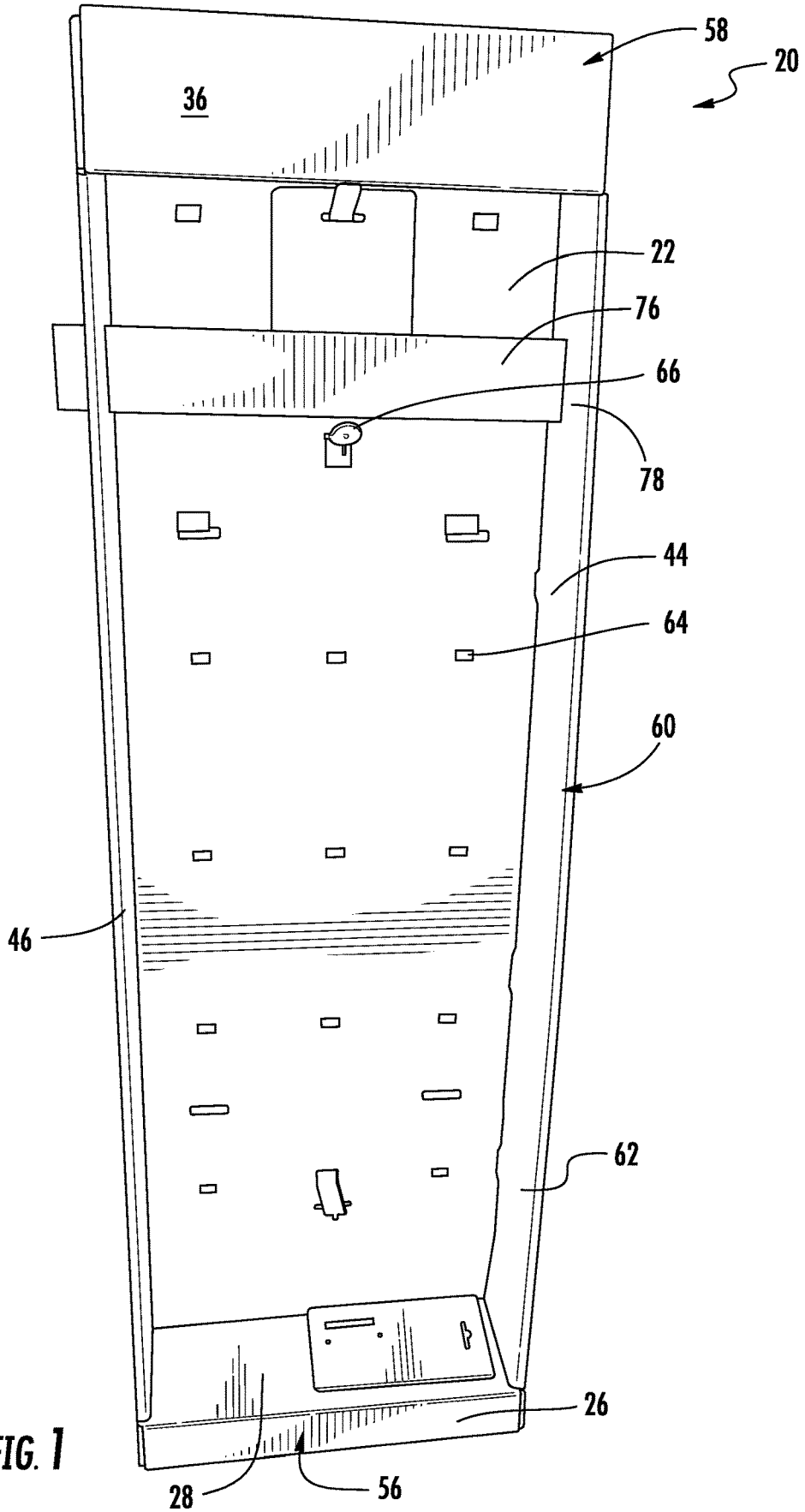
FIG. 1 is a front perspective view of a point-of-sale display assembly for retail of retail products according to an embodiment.
Figure 2:
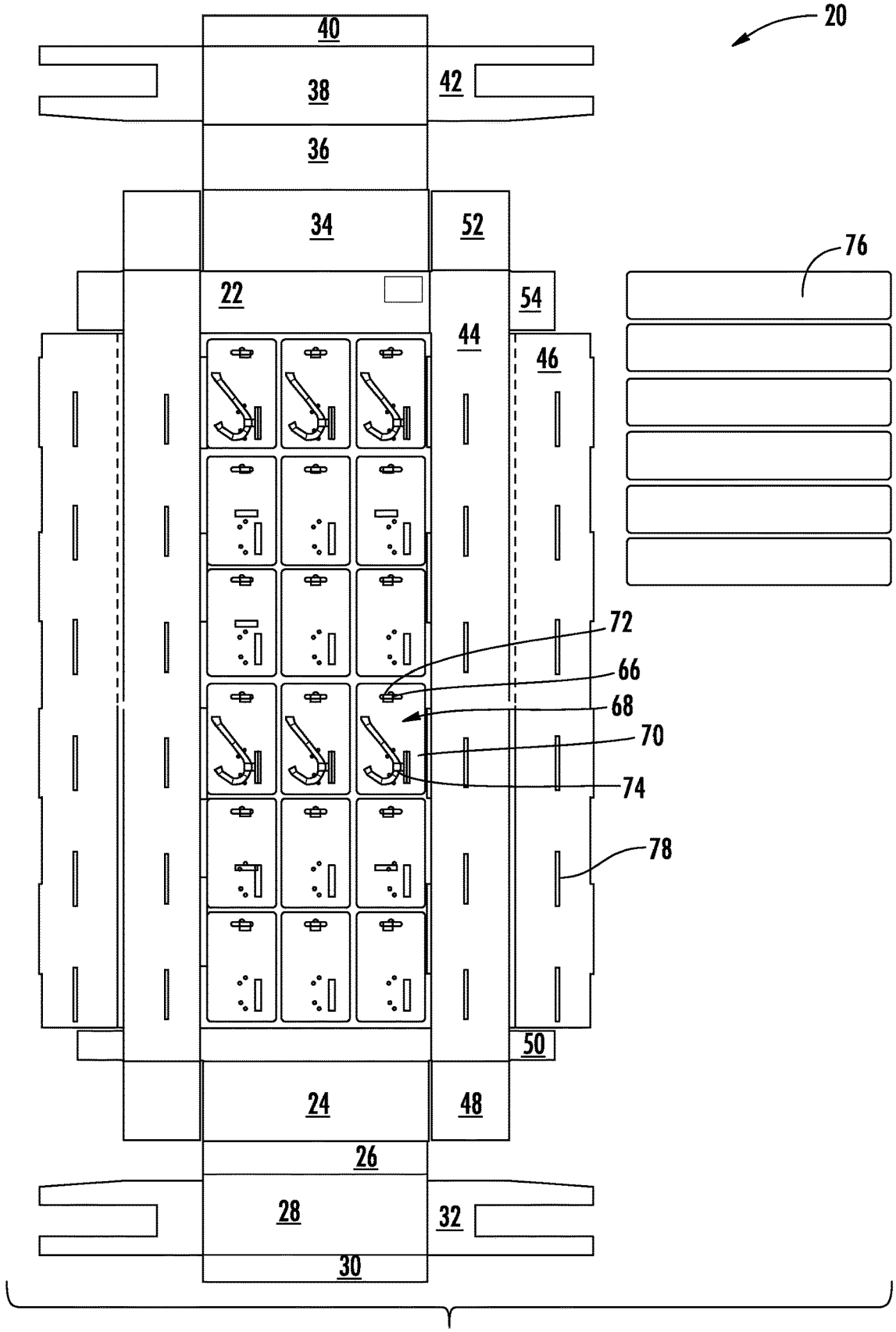
FIG. 2 is a partially exploded front elevation view of the display assembly of FIG. 1, illustrated in cooperation with retail products.

The display assembly 20 is illustrated upright for display or in preparation for display in FIGS. 1 and 3-5. The display assembly 20 is also illustrated partially exploded and flattened in FIG. 2. The display assembly 20 may include various panels formed integrally from a common sheet of material, as depicted in FIG. 2. The material of the display assembly may be corrugated cardboard, or any suitable material that offers structural integrity while minimizing weight.

The display assembly 20 includes a back panel 22 that extends along an interior of the display assembly 20. Referring now to FIG. 2, a base panel 24 is pivotally connected to a lower edge of the back panel 22 to be pivoted forward of the back panel 22 and to face the floor. As illustrated in FIGS. 1-5, a front footer panel 26 is pivotally connected to the base panel 24 to extend upright from the base panel 24. An interior footer panel 28 is pivotally connected to the front footer panel 26 and extends rearward from the front footer panel 26 and into engagement with the back panel 22. Referring back to FIG. 2, a fold tab 30 is pivotally connected to the interior footer panel 28 to fold against the back panel 22 and to be concealed by the front footer panel 26 and the interior footer panel 28. A pair of side support panels 32 is each pivotally connected to a lateral end of the interior footer panel 28 to fold beneath the interior footer panel 28 and add support to the display assembly 20.

Figure 3:
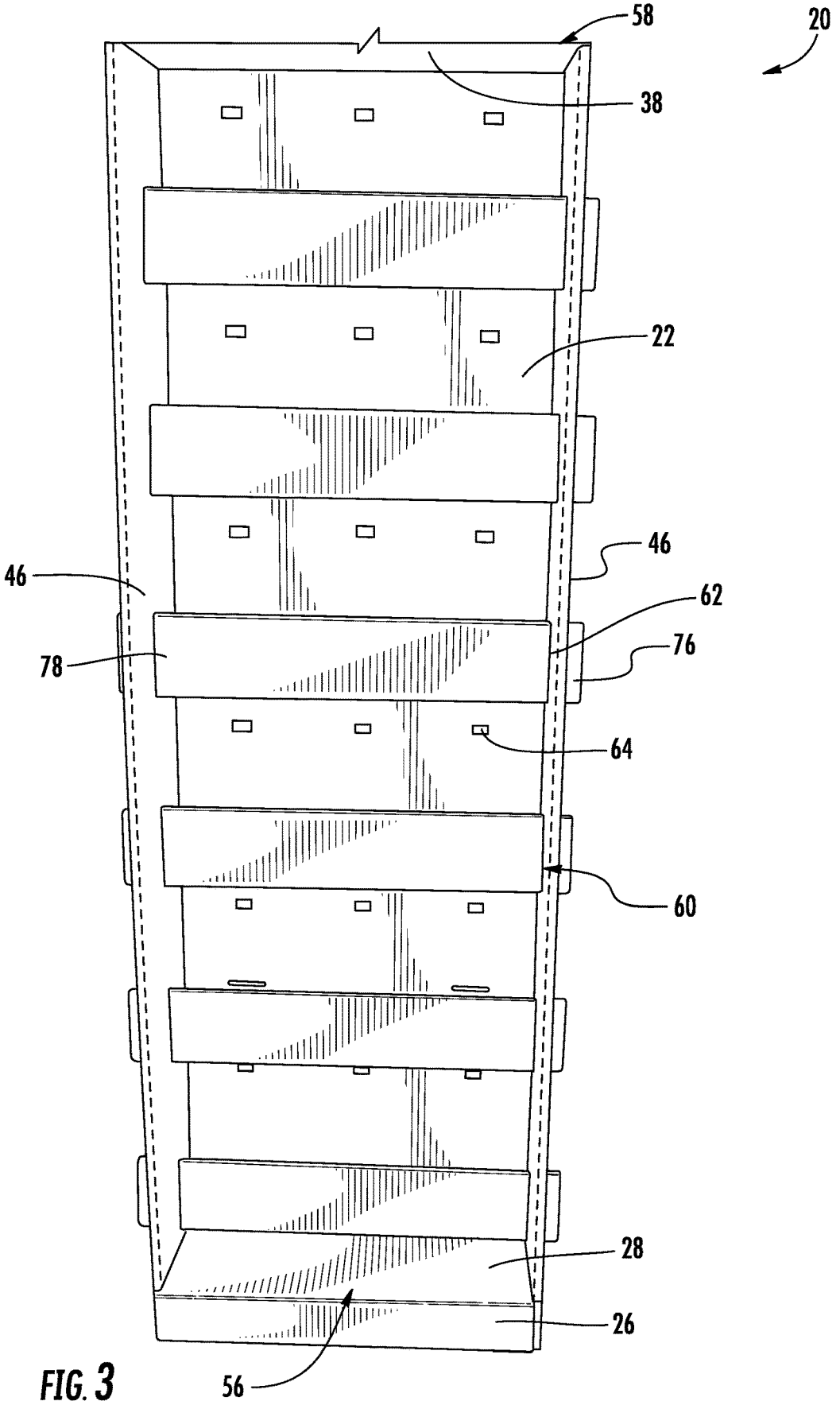
FIG. 3 is a front perspective view of the display assembly of FIG. 1 illustrated partially assembled without the retail products.
Figure 4:
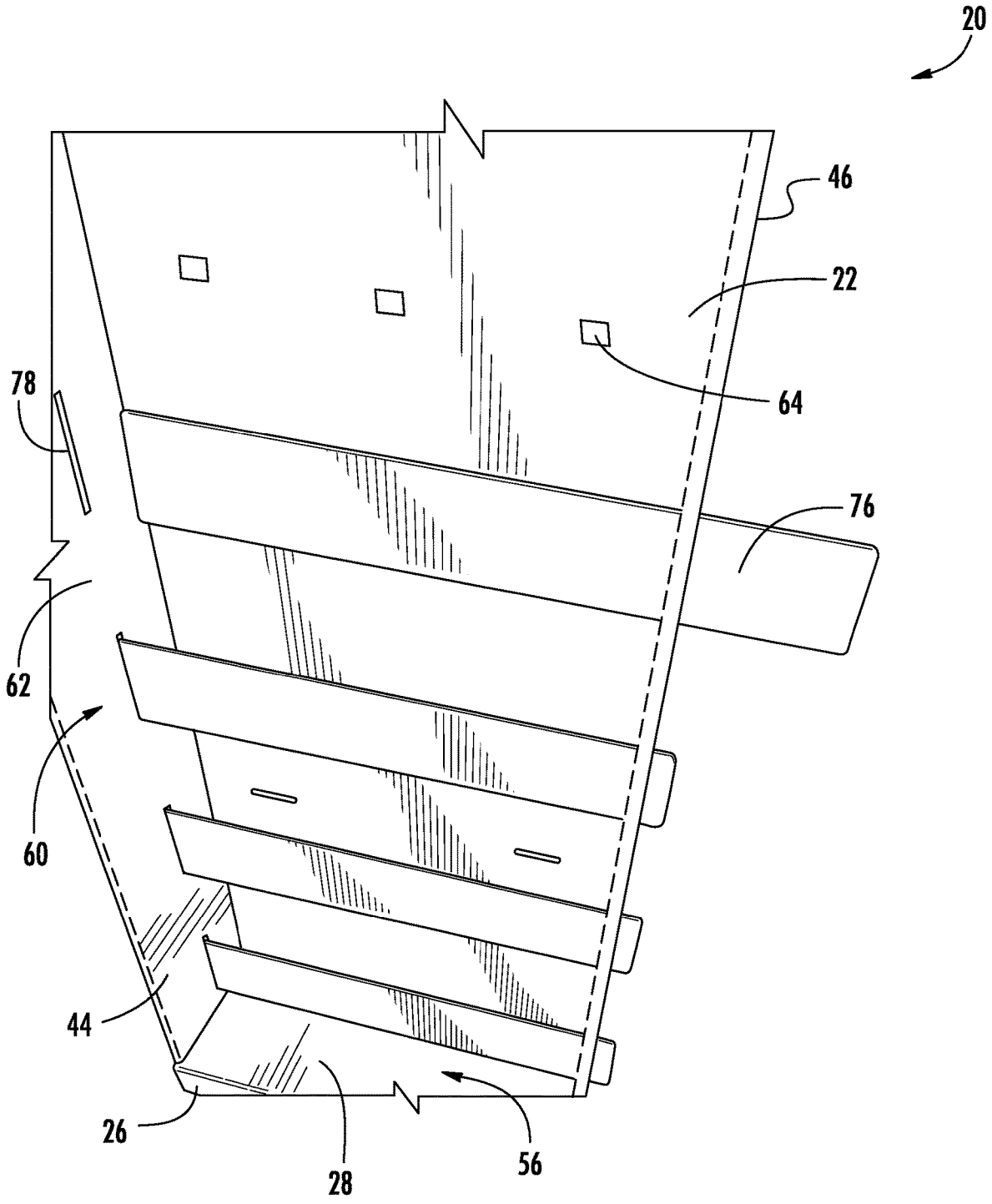
FIG. 4 is another front perspective view of the display assembly of FIG. 1 illustrated during an assembly step.
Figure 5:
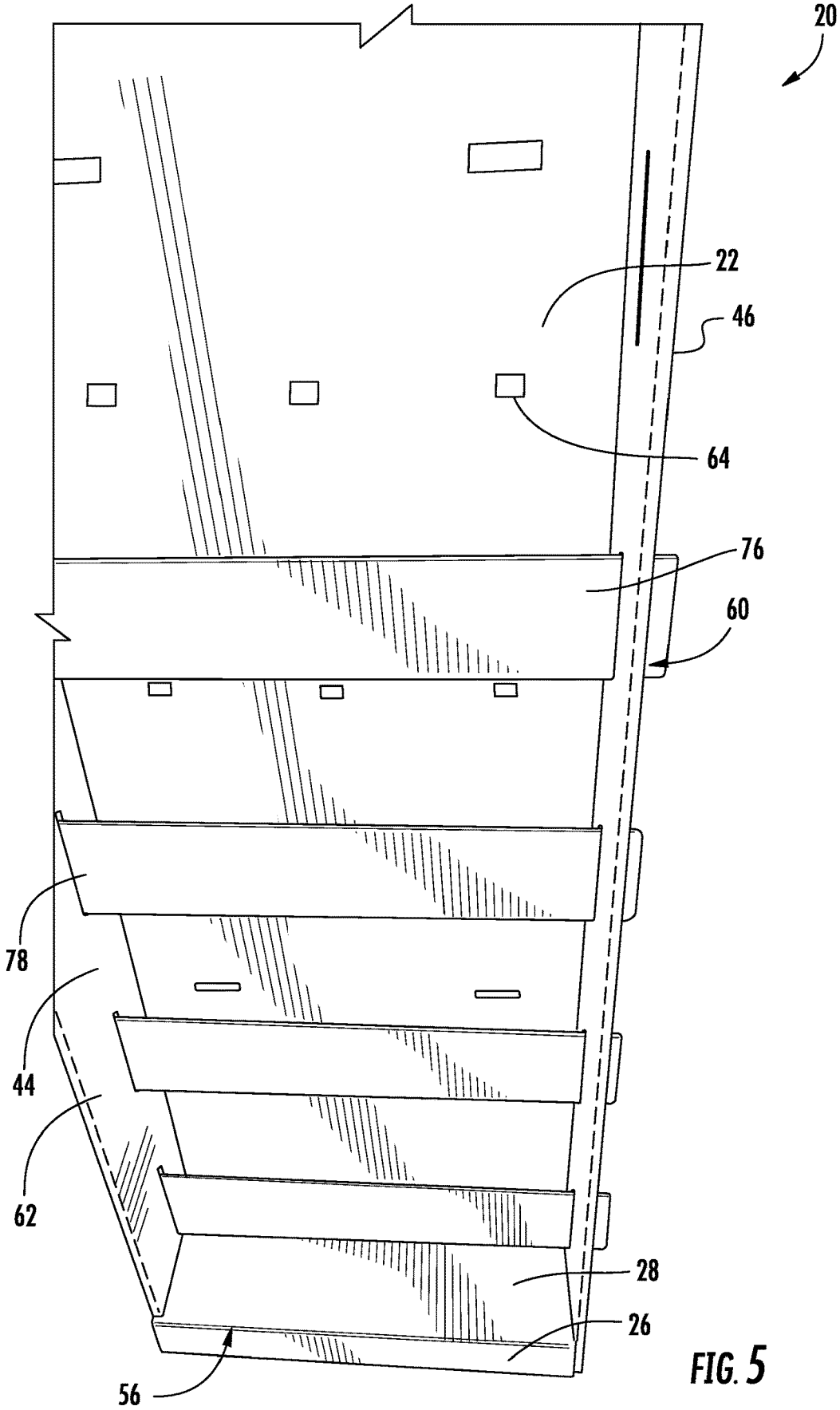
FIG. 5 is another front perspective view of the display assembly of FIG. 1 illustrated partially assembled.

With reference to FIG. 2, a top panel 34 is pivotally connected to an upper edge of the back panel 22 to be pivoted forward of the back panel 22. As illustrated in FIGS. 1 and 2, a front header panel 36 is pivotally connected to the top panel 34 to extend upright from the top panel 34. Referring now to FIGS. 2 and 3, an interior header panel 38 is pivotally connected to the front header panel 36 and extends rearward from the front header panel 36 and into engagement with the back panel 22. Referring back to FIG. 2, a fold tab 40 is pivotally connected to the interior header panel 38 to fold against the back panel 22 and to be concealed by the front header panel 36 and the interior header panel 38. A pair of side support panels 42 is each pivotally connected to a lateral end of the interior header panel 38 to fold beneath the interior header panel 38 and add support to the display assembly 20.

Referring now to FIGS. 1-5 a pair of interior side panels 44 is each pivotally connected to a lateral side of the back panel 22 to pivot forward of the back panel 22. A pair of exterior side panels 46 are each pivotally connected to an outboard lateral edge of one of the interior side panels 44 to fold along the interior side panels 44 and add additional support to the interior side panels 44.

Referring again to FIG. 2, a pair of horizontal footer support flaps 48 are each pivotally connected to a lower end of one of the interior side panels 44 to fold internally against the base panel 24. A pair of vertical footer support flaps 50 are each pivotally connected to a lateral edge of one of the interior side panels 44 adjacent to the fold of the corresponding horizontal footer support flap 48. Each vertical footer support flap 50 extends into the footer for engaging an internal surface of the base panel 24, the front footer panel 26, and the interior footer panel 28. The horizontal footer support flaps 48 and the vertical footer support flaps 50 interconnect the side panels 44, 46 to the footer panels 24, 26, 28, thereby interconnecting the various regions of the display assembly 20 and structurally enhancing the retail display assembly 20.

With continued reference to FIG. 2, a pair of horizontal header support flaps 52 are each pivotally connected to an upper end of one of the interior side panels 44 to fold internally against the top panel 34. A pair of vertical header support flaps 54 are each pivotally connected to a lateral edge of one of the interior side panels 44 adjacent to the fold of the corresponding horizontal header support flap 52. Each vertical header support flap 54 extends into the header for engaging an internal surface of the top panel 34, the front header panel 36, and the interior header panel 38. The horizontal header support flaps 52 and the vertical header support flaps 54 interconnect the side panels 44, 46 to the header panels 34, 36, 38, thereby interconnecting the various regions of the display assembly 20 and structurally enhancing the retail display assembly 20.

Once assembled, as illustrated in FIGS. 1 and 3-5, the display assembly 20 provides a footer 56, a header 58, and a pair of sidewalls 60 to define an opening 62 for access to retail products supported and displayed within the retail display assembly 20. In FIGS. 1 and 3-5, the back panel 22 includes an arrayed hole pattern 64 for mounting a plurality of pegs 66 (FIGS. 1 and 2) for supporting retail product assemblies 68 (FIG. 2) for display and sale at the point-of-sale retail location of the installed display assembly 20. Although pegs 66 are illustrated and described, the display assembly 20 may employ any suitable display hardware.

Each retail product assembly 68 in the depicted embodiment includes a cardboard backer 70 with an aperture 72 to receive one of the pegs 66. According to one embodiment, the retail product assembly 68 includes a home hardware product, such as a hook 74 supported upon each cardboard backer 70. The hooks 74 are displayed open upon the card backer 70 to permit tactile interaction by consumers to appreciate the materials and finish of the hooks 74. The display assembly 20 may be utilized to display any type of retail product in any type of product packaging.

As assembled, the display assembly 20 supports and displays the retail product assemblies 68 at a retail location for consumer viewing, inspection, interaction, and purchase. Although hooks 74 are illustrated and described, any retail product may be employed in the display assembly 20. For the depicted example, a pair of retail product assemblies 68 are supported upon each peg 66. However, any array of retail product assemblies 68 may be supported, with any reasonable number of rows, columns, and layers, as applicable for the selected merchandising design, floor space, and retail strategy.

According to a prior art example, the retail product assemblies 68 can be packaged separately and shipped with a collapsed and disassembled retail display assembly 20 to a retail location. Then, the retail display assembly 20 is assembled, and installed at the retail location. The retail product assemblies 68 are installed in the retail display assembly 20, and the packaging of the product assemblies 68 is discarded.

Figure 7:
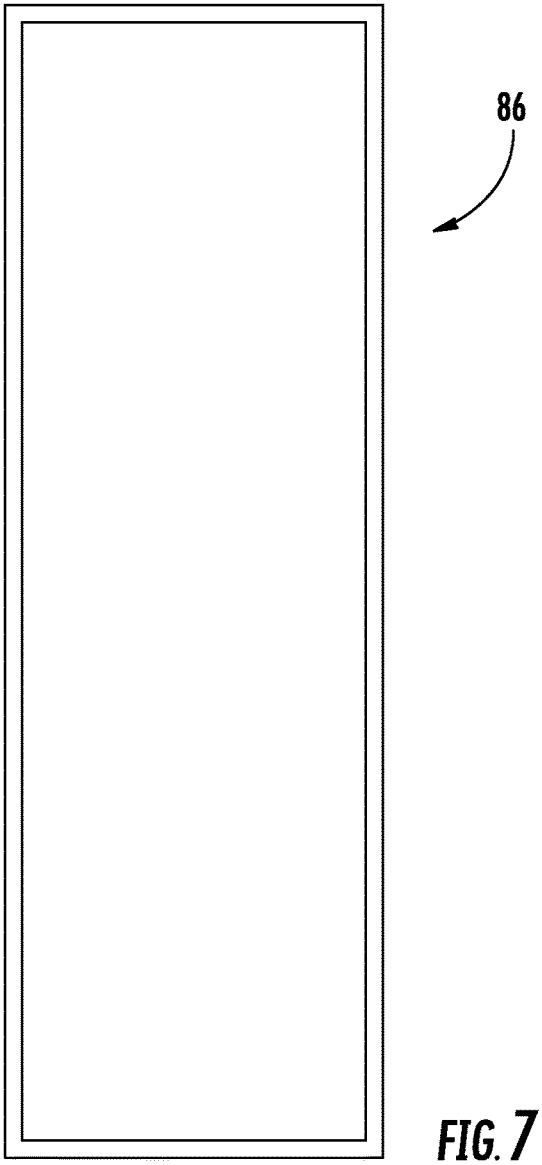
FIG. 7 is a rear elevation view of an outer case for the display assembly of FIG. 1 according to another embodiment.

In order to reduce packaging, packaging costs and labor costs of the retailer, the retail display assembly 20 can be utilized as the retail product package for shipping the retail product assemblies 68 from a manufacturer to a retail location. An outer case 86 (FIG. 7) can be installed at least partially over the packaged retail product display assembly 20 to cover the opening 62 in the product display 20 and to enclose the retail product assemblies 68 in the packaged retail product display assembly 20.

Upon receipt of the packaged retail product display assembly 20 at the retail location, there is no additional assembly, thereby reducing labor time and costs at the retail location. However, the individual packaging of the retail product assemblies 68 may expose the hooks 74 to damage during transportation and shipping from the manufacturer to the retailer. If the retail product assemblies 68 are individually packaged enclosed, damage could be avoided with additional packaging costs, while inhibiting the ability of the consumer to tactilely interact with the hooks 74.

Referring now to FIGS. 1-5, a plurality of dividers 76 are provided in the packaged retail product display assembly 20 to separate the retail product assemblies 68 and avoid damage of potential impacts and friction between exposed hooks 74 in the packaged retail product display assembly 20. A plurality of slotted apertures 78 are formed through the side panels 44, 46 to receive the dividers 76. The apertures 78 are aligned to fit between sequential layers of the retail product assemblies 68 in a depth direction.

Each divider 76 has a length greater than an overall width of the packaged retail product display assembly 20 to divide the retail product assemblies 68, while providing sufficient additional length to grasped and removed by an installer. The apertures 78 are oversized relative to the dividers 76 for ease in installation and removal. The dividers 76 are held in place by friction during assembly, and then maintained in place by the outer cover during transportation. The dividers 76 may also be formed of corrugated cardboard to be light weight, while also providing a sufficient barrier between sequential retail product assemblies 68 to minimize damage during transportation.

Upon receipt of the packaged retail product display assembly 20 at the retail location, minimal labor is required to utilize the packaged retail product display assembly 20 as the retail display assembly 20. The outer cover is removed thereby exposing the retail product assemblies 68. The dividers 76 are each removed by manual pulling of the dividers 76 from either side of the packaged retail product display assembly 20 to slide the dividers 76 out of the packaged retail product display assembly 20. The dividers 76 can be removed without removing any of the retail product assemblies 68 from the retail display assembly 20. After removal the dividers 76 can be discarded or recycled, which is less product waste than a separate shipping package for the retail product assemblies 68. The dividers 76 can also be removed without reducing a structural integrity of the retail display assembly 20.

The dividers 76 may also be employed in packaging applications other than displays 20. The dividers 76 can also be used in boxes, cases, trays or any other packaging application where the divider 76 separates products for transportation, and then subsequent removal without disturbing the product or compromising the integrity of the product package, while minimizing time and effort at the retail location.

Figure 6:
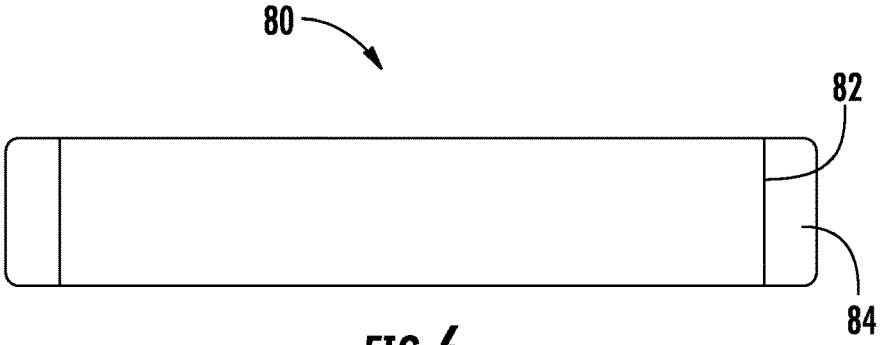
FIG. 6 is a front elevation view of a divider for the display assembly of FIG. 1 according to another embodiment.

FIG. 6 illustrates a divider insert 80 according to another embodiment. The divider 80 is similar to the prior embodiment and is sized to be installed within the slotted apertures 78 of the retail display assembly 20. The divider 80 may be formed from cardboard and includes score lines 82 formed within a body of the divider to weaken the divider 80 at locations for fold seams of the divider 80. The score lines 82 assist an assembler in folding distal ends 84 of the divider 80. Once the divider 80 is installed in the slotted apertures 78 in the sidewalls 60, the distal ends 84 are folded flat against the sidewalls 60 to reduce an overall size of the display assembly 20. After the distal ends 84 of the dividers 80 are collapsed, the outer case 86 (FIG. 7) is installed over the retail display assembly 20 and encloses the opening 62.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A packaging assembly comprising:

a product package comprising a back panel, wherein an arrayed hole pattern is formed in the back panel;

a plurality of pegs mounted to the arrayed hole pattern;

a plurality of retail products supported upon the plurality of pegs for support upon the product package in an array for transportation; and a plurality of dividers connected to the product package and extending between sequential retail products supported upon the same peg for separation of layers of the sequential retail products on the same peg during shipping, wherein the dividers are removable.

2. The packaging assembly of claim 1 wherein the product package further comprises:

a base panel connected to a lower edge of the back panel;

a top panel connected to an upper edge of the back panel; and a pair of side panels each connected to a lateral side of the back panel; and wherein the back panel, the base panel, the top panel, and the pair of side panels define an opening for access to an array of rows and columns of the plurality of retail products supported upon, and displayed within, the product package;

wherein each of the plurality of pegs are oriented in a depth direction; and wherein each of the plurality of dividers extend in a direction of the rows or a direction of the columns to divide the sequential retail products in the depth direction.

3. The packaging assembly of claim 2 wherein the product package is sized to hang or stand freely as a display assembly.

4. The packaging assembly of claim 1 wherein at least one of the plurality of retail products further comprises a card backer with an aperture sized to receive one of the pegs.

5. The packaging assembly of claim 4 wherein at least one of the plurality of retail products further comprises a home hardware product.

6. The packaging assembly of claim 5 wherein the home hardware product further comprises a hook.

7. The packaging assembly of claim 1 wherein at least one of the plurality of retail products is displayed open to permit tactile interaction by customers.

8. The packaging assembly of claim 2 further comprising an outer case sized to be installed at least partially over the product package to cover the opening to enclose the plurality of retail products in the product package for shipping of the packaging assembly.

9. The packaging assembly of claim 2 wherein a plurality of apertures is formed in at least one of the pair of side panels; and wherein the plurality of dividers extends through the plurality of apertures to align the plurality of dividers and to support the plurality of dividers.

10. The packaging assembly of claim 9 wherein the plurality of dividers extends through the apertures in the at least one of the pair of side panels for access to the plurality of dividers for removal of the plurality of dividers from the packaging assembly.

11. The packaging assembly of claim 9 wherein each of the plurality of dividers is formed with a score line along the divider to fold a distal end of the divider against an adjacent side panel of the pair of side panels.

12. The packaging assembly of claim 2 wherein the product package further comprises:

a front footer connected to the base panel and the pair of side panels; and a front header panel connected to the top panel and the pair of side panels.

13. The packaging assembly of claim 2 wherein the product package is formed integrally from a common sheet of material.

14. The packaging assembly of claim 13 wherein the product package is formed from corrugated cardboard.

15. A method for packaging products comprising:

forming a product package with a pair of side panels;

packing retail products in an array supported upon a plurality of pegs within the product package;

installing removable dividers through apertures through the pair of side panels and between sequential retail products on the same peg; and shipping the product package with retail products to a retailer.

16. The method of claim 15 further comprising:

forming the product package with an opening to display an array of rows and columns of the retail products, wherein each of the plurality of pegs are oriented in a depth direction, and wherein each of the removable dividers extend in a direction of the rows or a direction of the columns to divide the sequential retail products in the depth direction; and installing an outer cover over the product package to enclose the opening and retain the retail products prior to shipping the product package.

17. A method for retailing products comprising:

receiving a package of packed retail components at a retail location;

removing removable dividers from between the packed retail components on a common peg through apertures formed through a side panel of the package to allow access to multiple products on the same peg; and placing the package of packed retail components for retail at the retail location.

18. The method of claim 17 further comprising removing an outer case from the package to reveal an opening for access to an array of rows and columns of packed retail components before removing the dividers, wherein each of the plurality of pegs are oriented in a depth direction, and wherein each of the plurality of dividers extend in a direction of the rows or a direction of the columns to divide the sequential retail products in the depth direction.

19. The packaging assembly of claim 7 wherein the divider extends between a sequential pair of retail products adjacent to the open retail product.

20. The packaging assembly of claim 10 wherein the plurality of dividers is removable through at least one of the pair of side panels.

* * * * *